US008336733B2

(12) United States Patent
Laws et al.

(10) Patent No.: US 8,336,733 B2
(45) Date of Patent: Dec. 25, 2012

(54) SPRAY DISPENSER WITH COMPRESSED GAS CONTAINER

(75) Inventors: Karen Laws, Thame (GB); Duncan James Bradley, Ewhurst (GB); Nicholas John Campling, Peterborough (GB); Tristian Roger Thornhill, Peterborough (GB)

(73) Assignee: Shield Medicare Limited, Wiltshire (GB)

( * ) Notice: Subject to any disclaimer, the term of this patent is extended or adjusted under 35 U.S.C. 154(b) by 719 days.

(21) Appl. No.: 12/294,009

(22) PCT Filed: Mar. 22, 2007

(86) PCT No.: PCT/GB2007/001076

§ 371 (c)(1),
(2), (4) Date: Dec. 23, 2008

(87) PCT Pub. No.: WO2007/107778

PCT Pub. Date: Sep. 27, 2007

(65) Prior Publication Data

US 2009/0101680 A1 Apr. 23, 2009

(30) Foreign Application Priority Data

Mar. 22, 2006 (GB) ..... 0605841.6

(51) Int. Cl.
*B67D 7/00* (2010.01)

(52) U.S. Cl. ..... 222/5; 222/41; 222/399; 141/17; 141/19; 169/88; 239/309; 239/373

(58) Field of Classification Search ..... 141/17, 141/19; 239/309, 337, 373; 169/71, 78, 169/73, 85, 88; 222/4–6, 23, 41, 47–50, 222/391, 399, 400.5, 402.11, 402.15, 635, 222/135–136

See application file for complete search history.

(56) References Cited

U.S. PATENT DOCUMENTS

| | | | | | |
|---|---|---|---|---|---|
| 629,752 | A | * | 7/1899 | Murray | 141/17 |
| 2,016,301 | A | * | 10/1935 | Seat | 169/88 |
| 2,073,670 | A | * | 3/1937 | Allen | 222/5 |
| 2,182,742 | A | * | 12/1939 | Brewer | 222/399 |
| 2,208,490 | A | * | 7/1940 | Axtell et al. | 169/88 |
| 2,552,857 | A | | 5/1951 | Knapp | |
| 2,659,629 | A | | 11/1953 | Graham | |
| 2,822,002 | A | | 2/1958 | Mack | |
| 2,895,651 | A | * | 7/1959 | Mahon et al. | 222/635 |
| 3,270,920 | A | | 9/1966 | Nessler | |
| 3,610,470 | A | * | 10/1971 | Waters | 222/5 |

(Continued)

FOREIGN PATENT DOCUMENTS

BE 870 739 1/1979

(Continued)

*Primary Examiner* — Kevin P Shaver
*Assistant Examiner* — Andrew P Bainbridge
(74) *Attorney, Agent, or Firm* — Merchant & Gould P.C.

(57) ABSTRACT

A dispenser (1) includes a container (3) for the storage of a liquid, a gas cartridge receiving portion (5) for holding a gas cartridge (4) so that the contents of the container may be pressurized by gas in a gas cartridge, a dispensing arrangement for dispensing the liquid as a spray. The dispenser includes an activator (13) for moving a gas cartridge so that the gas cartridge is in position to pressurize the container, and an inhibitor (17) which inhibits movement of the dispensing arrangement. The activator is associated with the inhibitor so that movement of the inhibitor from the first to second inhibitor positions causes the activator to move the gas cartridge so that the gas cartridge is in position to pressurize the container.

20 Claims, 3 Drawing Sheets

U.S. PATENT DOCUMENTS

| | | | | |
|---|---|---|---|---|
| 3,667,549 | A * | 6/1972 | Sachs et al. | 169/71 |
| 4,088,194 | A | 5/1978 | Hard | |
| 4,586,570 | A * | 5/1986 | Swift | 169/75 |
| 4,650,004 | A * | 3/1987 | Wendling et al. | 169/85 |
| 4,658,184 | A | 4/1987 | Gaspar | |
| 4,702,396 | A * | 10/1987 | Gwiazda | 222/152 |
| 4,782,564 | A | 11/1988 | Sloan | |
| 5,558,255 | A * | 9/1996 | Sancoff et al. | 222/189.06 |
| 5,924,463 | A * | 7/1999 | Hsu et al. | 141/313 |
| 6,481,642 | B1 | 11/2002 | Louis, Jr. et al. | |
| 7,182,881 | B2 * | 2/2007 | Kato et al. | 252/7 |
| 7,752,974 | B2 * | 7/2010 | Wenaas et al. | 102/367 |
| 2001/0010316 | A1 | 8/2001 | Parsons et al. | |
| 2006/0169725 | A1 * | 8/2006 | Grill | 222/399 |

FOREIGN PATENT DOCUMENTS

| | | |
|---|---|---|
| CH | 335251 | 9/1955 |
| CH | 613 912 | 10/1979 |
| EP | 0 868 945 A1 | 10/1998 |
| FR | 2 308 813 | 11/1976 |
| FR | 2 602 685 | 2/1988 |
| GB | 1 205 485 | 3/1968 |
| GB | 1 332 528 | 8/1971 |
| GB | 1 317 627 | 5/1973 |
| GB | 1 379 346 | 1/1975 |
| JP | 2002-059044 | 2/2002 |

* cited by examiner

SPRAY DISPENSER WITH COMPRESSED GAS CONTAINER

This application is a National Stage Application of PCT/GB2007/001076, filed Mar. 22, 2007, which claims benefit of Serial No. 0605841.6, filed Mar. 22, 2006 in Great Britain and which applications are incorporated herein by reference. To the extent appropriate, a claim of priority is made to each of the above disclosed applications.

BACKGROUND OF THE INVENTION

The present invention relates to a spray dispenser for dispensing liquids, such as cleaning liquids and the like.

Many spray dispensers are known which use ambient air pressure in order to dispenser the contents of the dispenser. Repeated strokes of the trigger are needed to dispense large amounts of liquid; this is inconvenient and may prove to be tiresome if it is necessary to dispense large volumes of liquid.

SUMMARY OF THE INVENTION

In accordance with a first aspect of the present invention there is provided a dispenser comprising a container for the storage of a liquid, a gas cartridge receiving portion for holding a gas cartridge so that the contents of the container may be pressurized by gas in a gas cartridge and a dispensing arrangement for dispensing the liquid as a spray, the dispensing arrangement comprising an actuator, an outlet and a valve operable by the actuator, in use, to control the release of the liquid from the outlet.

Those skilled in the art will realize that the gas cartridge itself is not an essential part of the present invention.

Such a dispenser provides an effective way of dispensing liquids. It is preferred that the liquid comprises a cleaning agent, a disinfectant, denatured alcohol, biocide or the like. The liquid may be a solution or a suspension of particles dispersed in a liquid.

The actuator is preferably in the form of a trigger arrangement. Alternatively, the actuator may be in the form of a button.

The gas cartridge receiving portion may be provided with a means for rupturing a gas cartridge (for example, a piercer for piercing a gas cartridge). This facilitates the usage of disposable, non-reusable gas cartridge.

The dispenser may be provided with a gas cartridge. The gas cartridge may contain one or more of air, nitrogen and carbon dioxide. Such gases are convenient because they are readily available and inexpensive. The gas cartridge may be provided with a gas that may mix or react with one or more components of a liquid provided within the dispenser. For example, carbon dioxide may be used to acidify a liquid.

The dispenser may comprise a dip tube that, in use, extends within the container. A dip tube may typically extend from the valve to the bottom of a container, allowing most and preferably substantially all of the liquid to be dispensed from the container.

The dispenser may comprise two or more containment regions for the storage of liquid. This may be provided by the use of one or more vessels located within the container, or of one or more partitions in the container. The interior of the vessel may, for example, provide one containment region and the volume external to the vessel but internal to the container may provide another containment region. Each of these containment regions may, in use, contain mutually different liquids. On mixing, the two or more liquids may react to form a liquid that is to be dispensed, such as a cleaning solution. The dispenser may be provided with a mixing region for mixing the two or more different liquids; the mixing region may be provided in addition to the containment regions. For example, a mixing region may, in use, be above the containment regions (assuming that the dispenser is used in a generally upright orientation).

Each containment region may be provided with a dip tube. The cross-sectional area of the two or more dip tubes may be mutually different. Such an arrangement may allow two or more components to be drawn from the containment regions and subsequently mixed.

One or more of said vessels or partitions may be provided with one or more frangible portions that may be ruptured when the container is pressurized. This allows the components stored in the separate component spaces to be kept apart until use. This may be desirable if, for example, premature mixing is undesirable.

If the device comprises one or more vessels located within the container, said one or more vessel may comprise two such frangible portions. In use, the first portion may be associated with the gas cartridge and the second portion may be associated with the container, and the second portion is preferably remote from the first portion. This arrangement facilitates mixing of the component within the vessel with the component external to the vessel, but within the container. Said one or more vessels may be elongate. If the vessel comprises two frangible portions and the vessel is elongate, it is preferred that a frangible portion is located at or near each end of the vessel.

Such frangible portions may comprise material that may be readily burst when the container is pressurized. Foil is such a material.

The dispensing arrangement may comprise an outlet nozzle. The outlet nozzle is preferably operable to control the characteristics of the spray emitted from the dispenser. For example, a portion of the outlet nozzle may be movable (for example, by rotation) in order to control the characteristics of the spray emitted from the dispenser. The characteristics include the amount of liquid dispensed and the cone angle at which liquid is emitted. For example, the outlet nozzle may comprise a stop means movable in relation to the outlet to control the characteristics of the spray emitted from the dispenser. The stop means may be brought into sealing engagement with the outlet to inhibit dispensing of liquid.

The outlet may be provided by the outlet nozzle.

A mesh may be provided upstream of the outlet. A mesh may assist in the generation of a suitable spray.

The dispenser may be provided with a guard between the outlet and the actuator. The guard inhibits access to the outlet from the actuator and thus reduces the chance of the outlet coming into contact with the hand of a user which may contaminate the outlet. The guard may be in the form of an arm or bar. If the dispenser is provided with an outlet nozzle that comprises a portion that is movable in order to control the characteristics of the spray emitted from the dispenser, the guard may be associated with said portion so that movement of the guard causes said movement of said portion.

The dispensing arrangement may, in use, be movable relative to the container. In this case, the dispenser may be provided with a conduit extending between the container and the dispensing arrangement. This conduit typically facilitates the movement of the dispensing arrangement some distance from the container. This is particularly useful if it is desirable to spray sites that may be awkward to clean or if a larger container is required.

The container may be substantially cylindrical. The container may be made from a plastics material, such as high density polyethylene (HDPE), polyethylene terephthalate (PET) or polyethylene naphthalate (PEN). PET and PEN may facilitate the manufacture of containers with a smaller neck, which may assist use by operators with smaller hands. PEN is further advantageous because it has a higher softening temperature than PET; softening may cause "creep" of the shape of the container i.e. change of the shape of the container over time when the container is pressurized.

The base of the container may comprise a convex, dome shape. Such a structure is strong and resists "creep" of the shape of the container. If the base of the container comprises a convex, dome shape, it is preferred that the dispenser is provided with a stand for the dome shaped base. The stand may be suitable for use as a cap of the dispenser.

It is preferred that the valve is biased into a non-dispensing position, and that operation of the actuator causes the valve to move into a dispensing position. The valve may be biased into the non-dispensing position by a spring, such as a helical spring.

The gas cartridge receiving portion and dispensing arrangement may be readily removable from the container. This facilitates refilling of the container. The dispenser may comprise a head assembly, the head assembly comprising the gas cartridge receiving portion, the dispensing arrangement and a fastening portion for engagement with a corresponding fastening portion of the container. The use of such a head assembly facilitates convenient manufacture of the dispenser and easy filling and refilling of the container, if refilling is required.

It is preferred that the fastening portion comprises a screw thread, although other fastening arrangements may be used (a bayonet fitting, for example).

The valve may be removable. This may enable filling of the container other than through the neck of the container.

The dispensing arrangement may be provided with a filling inlet for introducing liquid into the container.

The dispenser may comprise a tamper-evident member indicative to a user of whether a gas cartridge has been moved into a pressurizing position (i.e. a position to pressurize the container). The tamper-evident member may, in use, be movable from a first tamper-evident member position, the first position being indicative of a gas cartridge not having been moved into a pressurizing position to a second tamper-evident member position, the second position being indicative of a gas cartridge having been moved into a pressurizing position. This allows the user to readily determine whether the dispenser has been pressurized. The tamper-evident member may be slidably movable between the first and second tamper-evident member positions. The tamper-evident member (or part thereof) may be coloured differently from adjacent parts of the dispenser. It is preferred that the dispenser is arranged so that once the tamper-evident member has been moved into the second tamper-evident member position, movement of the tamper-evident member to the first tamper-evident member position is inhibited and preferably prevented.

The dispenser may comprise an activator for moving a gas cartridge (and/or for moving a means for rupturing a gas cartridge, if present) so that the gas cartridge is in position to pressurize the container. Therefore, if the dispenser is provided with a means for rupturing a gas cartridge, the activator may be arranged to move the gas cartridge relative to the means for rupturing a gas cartridge. Therefore, the activator may be arranged to move one or both of the gas cartridge and the means for rupturing a gas cartridge in order to bring the gas cartridge and means for rupturing a gas cartridge into position so that the gas cartridge is ruptured and the dispenser is pressurised. It is preferred that the activator is for moving the gas cartridge, not the means for rupturing a gas cartridge.

The dispenser may comprise an inhibitor which is movable between a first inhibitor position in which it inhibits movement of one or more elements of the dispensing arrangement (for example, the trigger (if present)) so as to inhibit dispensing of liquid and a second inhibitor position in which the inhibitor permits movement of the said one or more elements of the dispensing arrangement so as to allow dispensing of liquid. In the second position, it is preferred that the inhibitor is attached to (and preferably integral with) the rest of the container. The one or more elements of the dispensing arrangement whose movement is inhibited so as to inhibit dispensing of liquid when the inhibitor is in the first inhibitor position may comprise one or more of the actuator (e.g. trigger) and valve.

The activator may be associated with the inhibitor so that movement of the inhibitor from the first to second inhibitor positions causes the activator to move the gas cartridge (and/or move the means for rupturing a gas cartridge, if present) so that the gas cartridge is in position to pressurize the container. The dispenser may be arranged so that movement of the activator to move the gas cartridge so that the gas cartridge is in position to pressurize the container is only performed on the first movement of the inhibitor from the first inhibitor position to the second inhibitor position.

The activator may be in contact with, connected to or attached to the inhibitor. Said movement of the inhibitor may be rotational. The activator may comprise or be the tamper-evident member.

The inhibitor may be provided with an aperture therethrough. For example, the inhibitor may be annular. The activator may be elongate. The activator and/or tamper-evident member may be disposed within the aperture of the inhibitor. Rotation of the inhibitor from the first to the second inhibitor positions may cause the activator to move the gas cartridge into position to pressurize the container. In this case, it is preferred that the activator acts as the tamper-evident member. Movement of the inhibitor may move the activator, this movement being evident to the user of the device. The position of the activator once the gas cartridge is in position to pressurize the device is indicative that the device has been pressurized.

It is preferred that once the activator has been moved into position to pressurize the container, the activator may not be retracted.

In accordance with a second aspect of the present invention, there is provided a cleaning kit comprising a dispenser in accordance with the present invention, one or more gas cartridges and a liquid or two or more components that may be mixed so as to form a liquid.

In accordance with a third aspect of the present invention, there is provided a method of dispensing a liquid, the method comprising:

(i) providing a dispenser comprising a gas cartridge for pressuring the contents of the dispenser and a dispensing arrangement for dispensing the contents of the dispenser, the dispensing arrangement comprising an actuator for controlling the dispensing of the contents of the dispenser, the dispenser containing two or more components that, on mixing, form a liquid (ii) causing the two or more components to mix and be dispensed.

The kit and method of the second and third aspects of the present invention respectively may use a dispenser in accordance as described in accordance with the first aspect of the present invention.

BRIEF DESCRIPTION OF THE DRAWINGS

The present invention will now be described by way of example only with respect the following figures of which.

DETAILED DESCRIPTION OF THE PREFERRED EMBODIMENTS

Figure 1:
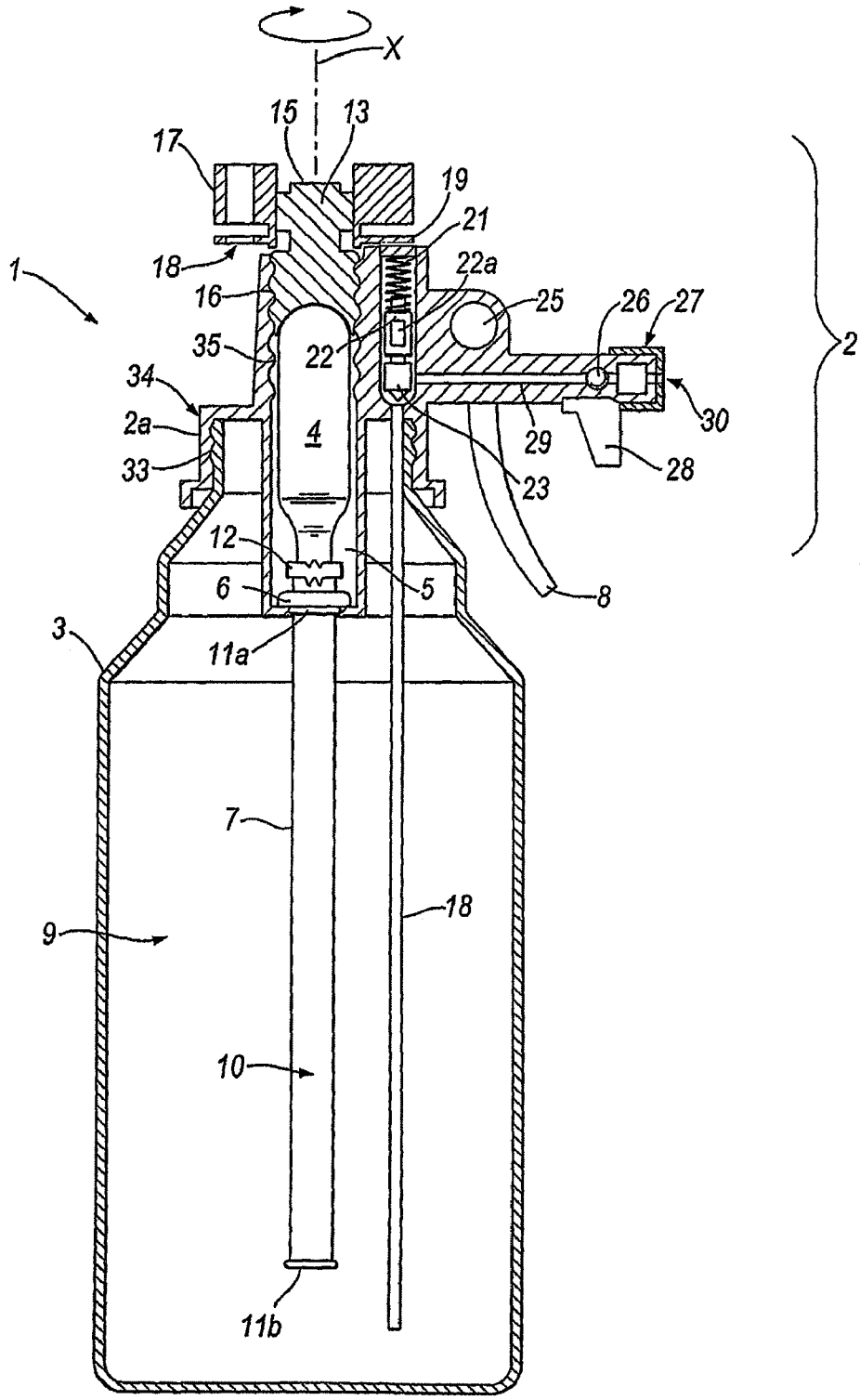
FIG. 1 shows a cross-sectional view of a first embodiment of a dispenser in accordance with the present invention, the dispenser being shown prior to pressurization of the container.

FIG. 1 shows a cross-sectional view through an embodiment of a dispenser in accordance with the present invention. FIG. 1 shows the dispenser prior to pressurization of the contents. The dispenser (denoted generally by reference numeral 1) comprises a container 3 for the storage of a liquid, a gas cartridge receiving portion 5 for holding a gas cartridge 4 so that the container may be pressurized by gas in a gas cartridge, a dispensing arrangement for dispensing the liquid as a spray, the dispensing arrangement comprising an actuator 8, an outlet 30 and a valve operable by the actuator, in use, to control the release of the liquid from the outlet.

The key components of the dispenser are now described briefly. The dispenser 1 is provided with an activator 13 for moving the gas cartridge onto a piercer 6 in order to pressurize the contents of the container. The activator is associated with an inhibitor 17 such that movement of the inhibitor causes the activator to come into contact with the gas cartridge and move the gas cartridge onto the piercer, thereby pressurizing the contents of the container. Furthermore, prior to the movement of the inhibitor, movement of the actuator is 8 inhibited, thus preventing any dispensing of the contents of the container. The inhibitor 17 is adapted so that the movement of the inhibitor which moves the gas cartridge onto the piercer also moves the inhibitor into a position that permits movement of the actuator (and thus possible dispensing of a spray). The activator also acts as a tamper-evident member 15; the activation process of moving the inhibitor causes the tamper-evident member to be moved, the position of the tamper-evident member after such movement being indicative of the dispenser having been activated. The piercing of the gas cartridge 4 causes gas to exit the cartridge, pushing a second liquid stored in containment region 10 (provided in a vessel 7) into mixture with a first liquid stored in containment region 9 provided between the vessel 7 and the inside of the container 3. Mixing of the first and second liquids forms a liquid ready for dispensing.

Liquid is dispensed from the container by operating the actuator 8 which is, in this case, in the form of a trigger. Pulling of the trigger moves a valve sealing means 23 away from a valve seat (not shown). This permits pressurized liquid to rise up dip tube 18, go through the outlet conduit 29 and be dispensed as a spray via outlet 30.

Figure 2:
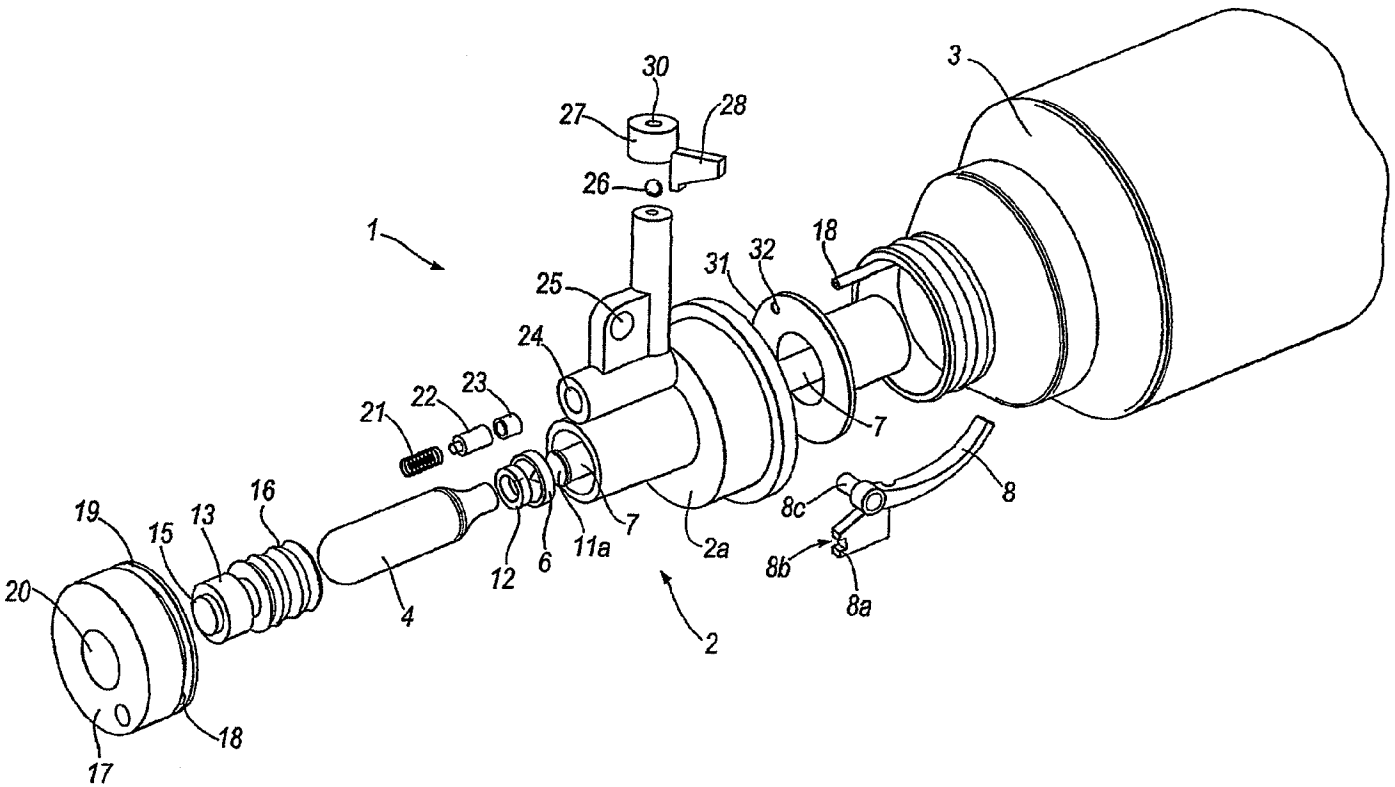
FIG. 2 shows an exploded view of the upper portion of the dispenser of FIG. 1.

The operation of the dispenser will now be described in more detail with reference to FIGS. 1 and 2.

The dispenser comprises a container 3 provided with a fastening configuration 33 in the form of a screw thread provided on the neck region of the container. A head assembly shown generally by reference numeral 2 is provided with a head assembly body 2*a*, the head assembly body 2*a* being attached to the container with a corresponding screw thread formed in a head assembly attachment portion 34. The head assembly body 2*a* provides the gas cartridge receiving portion 5, and provides aperture 25 for pivotal mounting of the actuator 8 and space 24 for location of the valve operable by the actuator. The head assembly body 2*a* also provides the outlet conduit 29 extending from the space 24 to the outlet 30, thus permitting egress of liquid. A sealing washer 31 is provided between the container 3 and the head assembly body 2*a*. An aperture 32 is provided in the sealing washer 31 for the dip tube to extend through.

Prior to use (for example, when in storage or during transportation), the contents of the container 3 are usually not pressurized and the dispenser 1 appears essentially as in FIG. 1. The activator 13 is arranged so as not to urge the gas cartridge 4 onto piercer 6. Gas cartridge 4 rests on a disk-shaped crushable support 12 that resists the gas cartridge being accidentally urged onto the piercer. A vessel 7 providing a containment region 10 filled with a second liquid is located just beneath the piercer 6 and is provided with two frangible portions 11*a*, 11*b*, one at either end of the vessel 7. One frangible portion (11*a*) is adjacent the piercer 6 and the other (11*b*) is near the bottom of the container 3. A further containment region 9 is provided between the container 3 and the vessel 7, this second containment region 9 being filled with a first liquid.

A mentioned previously, activator 13 also acts as a tamper-evident member 15. The top surface of tamper evident member 15 is substantially flush with the top surface of the inhibitor 17. The inhibitor 17 is substantially annular and is provided with a bore 20 through which at least the top surface of the tamper-evident member 15 is always visible. The lower portion of the activator 13 is provided with a screw thread 16 that mates with a corresponding screw thread 35 on head assembly body 2*a*. Actuator 8 is provided with a projection 8*a* which abuts against the underside of a flange 19 provided by the inhibitor 17. This abutment resists movement of the projection 8*a* in a substantially upwards direction, thus inhibiting movement of the trigger. This arrangement resists dispensing of the contents of the dispenser when the inhibitor is in this first position. Furthermore, prior to pressurization valve seal means 23 is urged into sealing contact with a valve seat (not shown) by spring 21 acting on valve member 22.

The pressurization of the contents of the container is now described. The user rotates inhibitor 17 in a clockwise manner by about 180 degrees about its longitudinal axis (the longitudinal indicated by "X" in FIG. 1). Rotation of the inhibitor 17 causes the inhibitor 17 to engage with the activator 13 and thus causes the activator 13 to rotate. The mating of the activator screw threads 16 with the corresponding screw threads 35 on the head assembly body 2*a* causes the rotational motion of the activator 13 to be accompanied by a downward motion towards the gas cartridge 4. Said movement of the inhibitor 17 causes the lower concave surface of the activator 13 to engage with the upper convex surface of the gas cartridge 4. The movement of the gas cartridge 4 crushes the crushable spacer 12, and moves the gas cartridge onto the piercer 6, piercing the gas cartridge 4. The egress of gas (in this case, carbon dioxide) bursts frangible portions 11*a*, 11*b*, and urges second liquid from containment region 10 out into containment region 9. This arrangement facilitates mixing of the first and second liquids 9 and 10 to form a liquid for dispensing.

Figure 3:
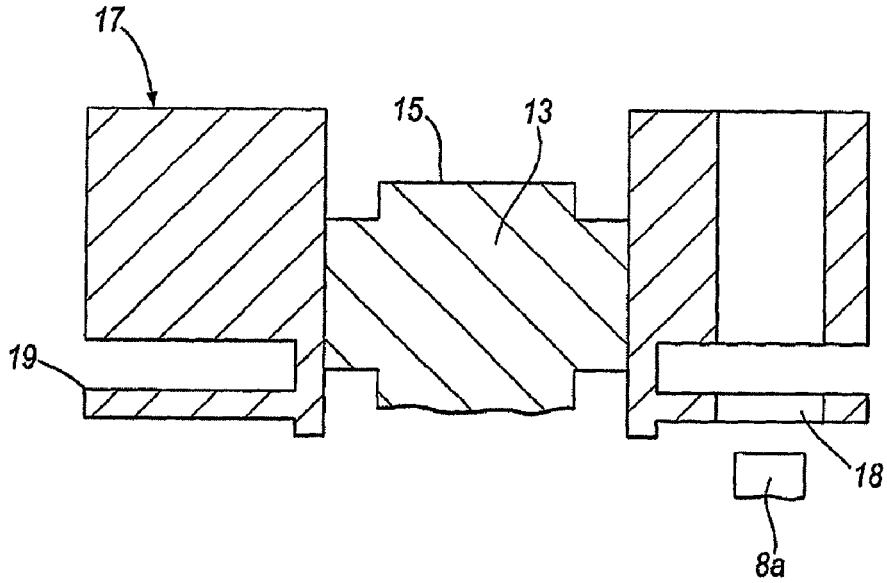
FIG. 3 shows a simplified cross-sectional view of an upper portion of the dispenser of FIG. 1 after the contents of the device have been pressurized.

The rotation of the inhibitor to pressurize the contents of the dispenser 1 causes the tamper-evident member 15 to move from a position in which the upper surface of the tamper-evident member 15 is substantially flush with the upper surface of the inhibitor 17 to a second position which the upper surface of the tamper evident member 15 is recessed, as shown in FIG. 3.

Rotation of the inhibitor to pressurize the contents of the container 3 also facilitates operability of the actuator 8. When the inhibitor has been rotated through about 180 degrees, a slot 18 is located above projection 8*a* provided on the actuator 8 (see FIG. 3). Pulling on the trigger causes the actuator 8 to rotate about pivot axle 8*c* which is located in aperture 25. This pivotal motion causes projection 8*a* to rise into the slot 18; prior to rotation of the inhibitor 17, the projection was not free to rise, since it engaged with the underside of flange 19.

The dispenser is provided with a ratchet that allows movement of the inhibitor in an anti-clockwise direction, but such movement does not cause the activator 13 and thus the tamper-evident member 15 to return to its pre-pressurisation position.

Dispensing of the contents of the device post-pressurization is now described. Pulling on the trigger causes rotational motion of the actuator 8 about axle 8*c*. This causes projection 8*a* to enter slot 18 provided on the flange 19 of the inhibitor 17. A portion of the actuator is located in trigger receiving portion 22*a* of valve member 22 and is arranged so that pulling on the trigger causes the said portion of the actuator and the valve member 22 to move away from the valve seat. This causes the valve seal means 23 to move away from the valve seat, allowing the pressure in the container 3 to urge liquid up dip tube 18, through outlet conduit 29 and out of the outlet 30. The spring 21 is arranged to urge the valve seal member into sealing engagement with the valve seat and thus provides an effective seal inhibiting egress of liquid when the actuator is not operated.

A ball valve 26 and nozzle 27 are provided near the outlet 30. The ball valve 26 is well-known to those skilled in the art and comprises a spring (not shown) that urges a ball into sealing engagement with a valve seat (not shown). Such a ball valve inhibits ingress of contaminants through the outlet 30. The nozzle 27 is operable so as to adjust the spray characteristics of the liquid released from the dispenser. The nozzle is provided with a stop means (not shown) that is movable relative to the outlet 30 to control the characteristics of the spray released from the dispenser. The stop means may be urged into contact with the outlet so as to effectively block the outlet and prevent dispensing of liquid. The outlet 30 is provided by the nozzle 27. The nozzle 27 is provided with guard 28. The guard 28 inhibits access to the outlet 30 when operating the trigger 8. The guard 28 is movable so as to move the stop means to adjust the spray characteristics of the fluid released from the dispenser. The guard 28 is rotatable about an axis parallel to the longitudinal axis of outlet conduit 29. The outlet provided by the nozzle may typically have a diameter of 0.5 mm. A mesh (not shown) may be provided immediately upstream of the outlet. The mesh has a pitch of 0.5 mm and assists in the formation of an atomized spray.

The second liquid (i.e. the liquid provided in the vessel 7) may, for example, be a solution of citric acid.

Experiments were undertaken to determine how operation of the dispenser of FIG. 1 varied with the starting pressure in the container. A dispenser made in accordance with FIG. 1 was provided using a container having a nominal volume of two liters. The container was provided with a pressure gauge and a pressure-release valve so that the pressure in the container could be controlled and measured.

The pressure in the container was measured as a function of the volume of headspace above the liquid to be dispensed. The container was provided with liquid so that a headspace of nominal size existed above the liquid. The container was then pressurized using a carbon dioxide canister as described above. As expected, a smaller headspace resulted in a higher pressure in the container; a nominally 800 ml headspace resulted in a pressure of 4.5 bar, a nominally 400 ml headspace resulting in a pressure of 7.5 bar and a nominally 350 ml headspace giving a pressure of 8.0 bar. All starting pressures were sufficient to dispense the contents of the container.

The effect of starting pressure on the pressure in the container after dispensing a certain volume of liquid was investigated. The container was provided with sufficient liquid (in this case, water) to generate a headspace having a nominal 400 ml volume. The pressure-release valve was operated to provide the desired starting pressure in the container. The pressure in the container was noted after dispensing a liter of water. As expected, the pressure after dispensing a liter of liquid reflected the starting pressure, a higher starting pressure giving a higher pressure after dispensing a liter of liquid.

These experiments indicate that the starting pressure generated by the carbon dioxide capsule is higher than needed to ensure dispensing of the contents of the dispenser. Furthermore, it may be desirable to reduce the starting pressure in order to reduce "creep" of the shape of the container.

Those skilled in the art will realize that other configurations of dispenser fall within the scope of the present invention. For example, the dispensing arrangement may be movable relative to the container. This facilitates the use of a large container and/or facilitates the use of a small dispensing arrangement that would be convenient in accessing awkward spaces.

The invention claimed is:

1. A dispenser comprising a container for the storage of a liquid, a gas cartridge receiving portion for holding a gas cartridge so that the contents of the container are selectively pressurized by gas in a gas cartridge and a dispensing arrangement for dispensing the liquid as a spray, the dispensing arrangement comprising an actuator, an outlet and a valve controlled by the actuator to control the release of the liquid from the outlet, the dispenser comprising an activator that selectively moves a gas cartridge so that the gas cartridge is in position to pressurize the container, and an inhibitor which is movable between a first inhibitor position which inhibits movement of one or more elements of the dispensing arrangement so as to inhibit dispensing of liquid and a second inhibitor position in which the inhibitor permits movement of said one or more elements of the dispensing arrangement so as to allow dispensing of said liquid, wherein upon movement of the inhibitor from the first inhibitor position to the second inhibitor position, the activator moves the gas cartridge to pressurize the container.

2. A dispenser according to claim 1 wherein the dispenser comprises two or more containment regions for the storage of liquid.

3. A dispenser according to claim 1 comprising a tamper-evident member indicative to a user of whether a gas cartridge has been moved into a pressurizing position.

4. A dispenser according to claim 1, wherein the actuator is in the form of a trigger arrangement.

5. A dispenser according to claim 1, wherein the gas cartridge receiving portion is provided with a means for rupturing a gas cartridge, and the dispenser is provided with a gas cartridge.

6. A dispenser according to claim 5 wherein the gas cartridge is provided with a gas that, in use, reacts with one or more components of a liquid provided within the dispenser.

7. A dispenser according to claim 2, wherein the container is provided with two containment spaces, wherein the two containment spaces are provided by the use of one or more vessels located within the container, or of one or more partitions in the container.

8. A dispenser according to claim 7 wherein each of the containment regions contains mutually different liquids, which, on mixing, may react to form a liquid that is to be dispensed.

9. A dispenser according to claim 7 wherein one or more of said vessels or partitions is provided with one or more frangible portions that may be ruptured when the container is pressurized.

10. A dispenser according to claim 9 comprising one or more vessels located within the container, said one or more vessel comprising two such frangible portions.

11. A dispenser according to claim 10 wherein, in use, the first portion is associated with the gas cartridge and the second portion is associated with the container, the second portion being remote from the first portion.

12. A dispenser according to claim 11 wherein the vessel comprises two frangible portions and is elongate, a frangible portion being located at or near each end of the vessel.

13. A dispenser according to claim 1 comprising a tamper-evident member indicative to a user of whether a gas cartridge has been moved into a pressurizing position, the tamper-evident member being, in use, movable from a first tamper-evident member position, the first position being indicative of a gas cartridge not having been moved into a pressurizing position to a second tamper-evident member position, the second position being indicative of a gas cartridge having been moved into a pressurizing position.

14. A dispenser according to claim 13 wherein the tamper-evident member is slidably movable between the first and second tamper-evident member positions.

15. A dispenser according to claim 14 wherein the dispenser is arranged so that once the tamper-evident member has been moved into the second tamper-evident member position, movement of the tamper-evident member to the first tamper-evident member position is inhibited.

16. A dispenser according to claim 1 comprising an activator for moving a gas cartridge so that the gas cartridge is in position to pressurize the container and a tamper-evident member indicative to a user of whether a gas cartridge has been moved into a pressurizing position, wherein the activator comprises or is the tamper-evident member.

17. A dispenser according to claim 1 comprising a guard between the outlet and the actuator, the guard inhibiting access to the outlet from the actuator.

18. A cleaning kit comprising a dispenser in accordance with claim 1, one or more gas cartridges and a cleaning liquid or two or more components that may be mixed so as to form a cleaning liquid.

19. A dispenser comprising:

a container for the storage of a liquid, a movable gas cartridge receiving portion for holding a gas cartridge so that the contents of the container are selectively pressurized by gas in a gas cartridge when the gas cartridge is selectively moved to a pressurizing position, and a dispensing arrangement for dispensing the liquid as a spray, the dispensing arrangement comprising an actuator, an outlet and a valve controlled by the actuator, to control the release of the liquid from the outlet, and an inhibitor which is movable between a first inhibitor position which inhibits movement of one or more elements of the dispensing arrangement so as to inhibit dispensing of liquid and a second inhibitor position in which the inhibitor permits movement of said one or more elements of the dispensing arrangement so as to allow dispensing of said liquid, wherein upon movement of the inhibitor from the first inhibitor position to the second inhibitor position, the activator moves the gas cartridge to pressurize the container;

wherein the dispenser comprises two or more containment regions for the storage of liquid.

20. A dispenser comprising:

a container for the storage of a liquid, a movable gas cartridge receiving portion for holding a gas cartridge so that the contents of the container are selectively pressurized by gas in a gas cartridge when the gas cartridge is selectively moved to a pressurizing position, and a dispensing arrangement for dispensing the liquid as a spray, the dispensing arrangement comprising an actuator, an outlet and a valve controlled by the actuator, to control the release of the liquid from the outlet, and an inhibitor which is movable between a first inhibitor position which inhibits movement of one or more elements of the dispensing arrangement so as to inhibit dispensing of liquid and a second inhibitor position in which the inhibitor permits movement of said one or more elements of the dispensing arrangement so as to allow dispensing of said liquid, wherein upon movement of the inhibitor from the first inhibitor position to the second inhibitor position, the activator moves the gas cartridge to pressurize the container;

wherein the dispenser comprises a tamper-evident member indicative to a user of whether a gas cartridge has been moved into the pressurizing position.

* * * * *